United States Patent [19]

Kallens et al.

[11] Patent Number: 5,022,156

[45] Date of Patent: Jun. 11, 1991

[54] HANDLE FASTENER ASSEMBLY AND METHOD OF MAKING SAME

[75] Inventors: Nicholas Kallens, 20 Cahuilla Hills Dr., Palm Springs, Calif. 92262; Steven Gabbay, Palm Springs, Calif.

[73] Assignee: Nicholas Kallens, Palm Springs, Calif.

[21] Appl. No.: 565,500

[22] Filed: Aug. 10, 1990

[51] Int. Cl.[5] ..... B26B 5/00; B26B 29/00

[52] U.S. Cl. ..... 30/125; 30/332; 30/337

[58] Field of Search ..... 30/123, 151, 161, 329, 30/332, 333, 335, 337-339

[56] References Cited

U.S. PATENT DOCUMENTS

| | | | |
|---|---|---|---|
| 2,601,450 | 6/1952 | O'Neill | 30/332 |
| 3,927,473 | 12/1975 | Braginetz | 30/125 |
| 4,713,884 | 12/1987 | Dunnagan | 30/339 |

*Primary Examiner*—Douglas D. Watts
*Attorney, Agent, or Firm*—Potthast & Ring

[57] ABSTRACT

A tool holder assembly having a pair of mating handle parts which hold a tool therebetween and which form a compartment therebetween, in which the improvement is a releasable handle fastener assembly. This assembly comprises: a pair of aligned mounting holes located in each of the mating handle parts spaced across the compartment; an elongate shaft assembly is mounted to one of the mating handle parts which includes a shaft which slideably extends through the mounting hole in one of the handle parts and has a spring retainer cap on one end of the shaft on an outer side of that handle part, and a groove in the shaft a preselected distance from the spring retainer cap; a bias spring is interposed between the cap and the outer side of that handle part for resiliently biasing the shaft in away from the outer side of that handle part; a C-clamp mounted to the groove which blocks the shaft moving out of the mounting hole and compressing the spring a preselected distance; and a cross member at an end of the shaft opposite the spring retaining cap; and a cross member slot extending transversely of the mounting hole in the other handle part to receive cross member and permit it to be locked, further shaft extends between the retainer and the other handle part.

19 Claims, 1 Drawing Sheet

Fig. 1
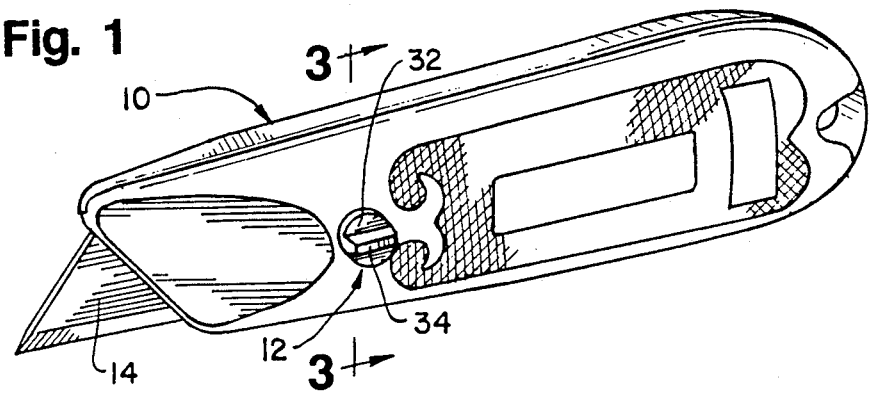
Fig. 2
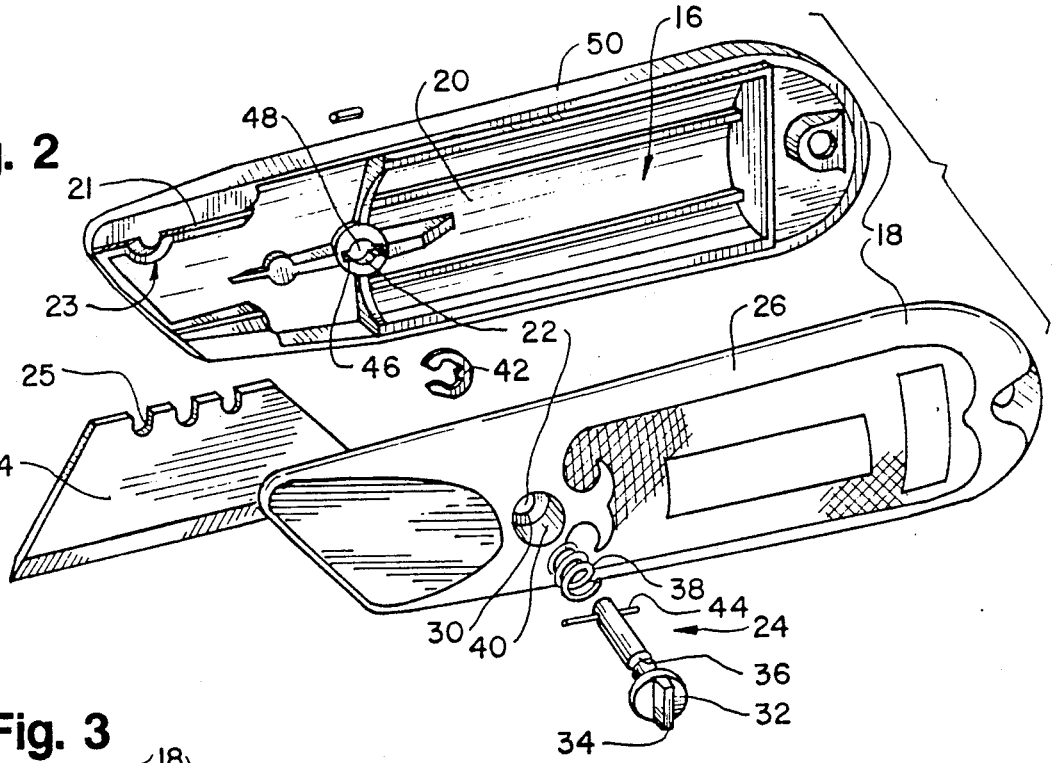
Fig. 3
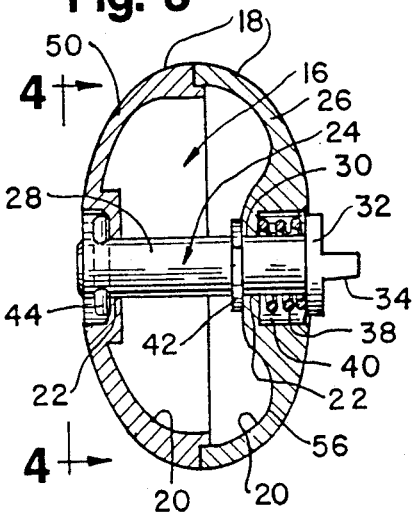
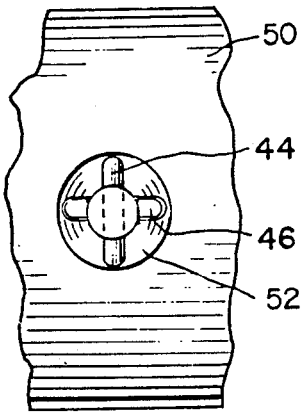
Fig. 4
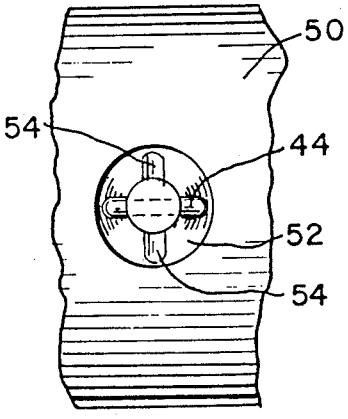
Fig. 5

HANDLE FASTENER ASSEMBLY AND METHOD OF MAKING SAME

BACKGROUND OF THE INVENTION

This invention relates to a tool handle assembly, generally, and to an improved releasable handle fastener and method particularly adapted for releasably securing a pair or mating handle parts of a tool holder.

Various tool handle assemblies are known which secure handles without compartments in the handle. In U.S. Pat. No. 3,007,244 issued Nov. 7, 1961 to Austin, a blade tool is secured between a resilient sleeve compressed by a T-bolt. In U.S. Pat. No. 4,408,396 issued Oct. 11, 1983 to Scholl, the handle is secured by a conventional rivet.

While these function to secure handle portions of a blade tool holder, neither provides for securing handle parts having compartmental forming segments and Scholl does not provide for easy release of the handle parts.

Various tool handle assemblies are known which secure handle parts having compartment forming segments. In U.S. Pat. No. 3,888,002 issued June 10, 1975 to Grahorn, the handle parts are secured together by a conventional screw. In U.S. Pat. No. 4,575,940 issued Mar. 18, 1986 to Wenzel, the handle parts are secured by a conventional screw that passes through one handle part and threadingly secures to the other handle part with a spring on the shaft of the screw interposed between both handle parts.

While both of the fasteners function to releasibly secure handle parts having compartment forming segments, neither are capable of maintaining the fastener secured to one handle part when the fastener is disengaged from the other handle part. Further, Wenzel does not secure the biasing spring to the fastener assembly when the fastener is completely disengaged to permit access to the compartment within the handle. This situation can create an inefficient and frustrating experience to a user when disengaging the handle parts to gain access to a compartment within the handle parts when the fasten comes off of the one handle part.

U.S. Pat. No. 4,657,462 issued Apr. 14, 1987 to Hoen, provides a quarter turn fastener for removably securing a first panel to a second panel. The device utilizes a bolt portion, a spring retainer, a spring to bias the fastener to the top of the first member to be secured. Hoen further utilizes a locking ring retainer on the shaft of the fastener beneath the first sheet member to be secured. This locking ring can ride up the shaft when the two sheet metal members are secured together and does not move downwardly when the fastener is released. When the fastener is secured, the locking ring rests immediately on top of the second member that is secured and immediately under the first sheet member.

This device does not have any shaft of the fastener extending between the locking ring and the second sheet member. As a result, it is not capable of securing two members together that are spaced apart. Further, its locking ring does not maintain a preselected distance from the spring retainer cap, as a result, the compression force on the spring will not be a constant but will vary depending on the thickness of the first sheet member to be secured. This varying of compression force does not provide for stabilizing the fastener in alignment between the openings of the two sheet members to be fastened when the fastener is disengaged. As a result, it does not provide ease in securement of the members being secured in the blind.

SUMMARY OF THE INVENTION

It is therefore an object of this invention to provide a fastener assembly which secure handle parts which have segments forming compartments in which the mounting holes are spaced apart.

It is a further object of this invention to provide a preselected compression force in the spring of the fastener assembly to keep the fastener assembly in substantial alignment of the mounting holes.

It is a further object of this invention to maintain the fastener assembly engaged to one of the bundle parts.

It is a further object to provide a fastener assembly that is easy to use and assemble and provides efficient and expedient releasable securement of a tool holder assembly. These objectives are accomplished by providing a tool holder assembly having a pair of mating handle parts which close together to hold a tool therebetween and which have spaced apart segments to form a compartment therebetween. The impovement being a releasable handle fastener assembly, comprising a pair of aligned mounting holes respectively located in the pair of mating handle parts at said compartment forming segments, respectively. An elongate shaft assembly is mounted to one of the mating handle parts. The elongate shaft assembly has a shaft which slideably extends through the mounting hole in one of the handle parts which includes the following: a spring retainer cap on one end of the shaft on an outer side of the one mating handle part; a means for establishing a preselected distance along the shaft from spring retainer cap; a bias spring is interposed between the cap and the outer side of the one handle part for resiliently biasing the shaft for sliding movement of the cap in a direction away from the outer side of the one handle part; a retainer cooperating with the preselected distance establishing means for mounting thereof to the shaft at a preselected distance from the spring retainer cap to block sliding movement of the shaft in a direction away from the outer side of the one handle part in response to the resilient biasing of the shaft caused by the bias spring and to establish a preselected compression force on the bias spring associated with the preselected distance; and a cross member at an end of the shaft opposite the spring retaining cap and extending laterally away from the shaft. A cross member slot extends transversely of the mounting hole in the other handle part for receipt of the cross member therethrough when aligned therewith, the cross member overlies an outer surface of the other handle part to block removal of the shaft, which shaft extends between the retainer and the other handle part, when moved to an angular position of nonalignment with the cross member slot.

A method of making a tool holder assembly is also provided, which has a pair of mating handle parts which close together to hold a tool therebetween. The steps of the method are as follows: providing a pair of aligned mounting holes in the mating handle parts, respectively; passing a fastener shaft through one of the mounting holes with a bias spring interposed between an outer side of the one mating handle part and a spring retainer cap carried at one end of the shaft; connecting a retainer to the shaft on an inner side of the one handle part after the shaft is passed through the one mounting hole to block removal of the shaft from the one mounting hole and to place the retainer spring in compressive tension; attaching a cross member to the shaft at an end opposite the spring retainer cap which extends laterally from the shaft after the shaft is passed through the one mounting hole; and providing a cross member slot extending transversely of the mounting hole in the other one of the pair of mating handle parts for receipt of the cross member only when aligned therewith.

BRIEF DESCRIPTION OF THE DRAWINGS

The foregoing objects and advantageous features of the invention will be explained in greater detail and others will be made apparent from the detailed description of the preferred embodiment of the present invention which is given with reference to the several figures of the drawing, in which:

FIG. 1 is a perspective view of the tool holder assembly secured by the releasable handle fastener assembly;

FIG. 2 is an exploded parts view of FIG. 1;

FIG. 3 is a cross sectional view of the holder assembly along line 3—3 as shown in FIG. 1;

FIG. 4 is a partial segment view of the holder assembly as viewed from direction as shown by line 4—4 of FIG. 3; and FIG. 5 is a partial segment view of the holder assembly in FIG. 4 with the cross member aligned with the cross member slot.

DETAILED DESCRIPTION

Referring now to these drawings, tool holder assembly 10 as seen in FIG. 1, has an improved releasable handle fastener assembly 12 for easy and efficient removal of blade tool 14, or any other mountable tool of the like, and access to a compartment 16 formed by mating handle parts 18 which have spaced apart segments 20, as seen in FIGS. 1–3.

Blade tool 14 is secured by ridges 21 as seen in FIG. 2 which press against blade tool 14 when fastener assembly 12 is fully assembled. Further, holding of blade 14 can be provided by providing a block portion 23 which can mechanically lock into a blade tool groove 25.

Fastener assembly 12 has a pair of aligned mounting holes 22 located one each in pair of mating handle parts 18, as seen in FIGS. 3 and 4. Mounting holes 22 are located at compartment forming segments 20 and as a result are spaced apart.

Fastener assembly 12 has an elongate shaft assembly 24 mounted to one of the mating handle parts 18, 26, as seen in FIGS. 2 and 3. Assembly 12 has shaft 28 which slideably extends through mounting hole 30 of mounting holes 22 of one of the mating handle parts 26. Shaft 28 and mounting hole 30 are typically round in configuration. However, they can be of many different configurations so long as shaft 28 can slide through mounting hole 30.

Spring retainer cap 32, as seen in FIGS. 1–3, is located on the outside end of shaft 28, which is also located outside of one mating handle part 26. Retainer cap 32 has a handle 34 mounted to it and, as can be seen, handle 34 can be integral with cap 32.

Further, shaft assembly 24 has a means for establishing a preselected distance 36 along shaft 28 from spring retainer cap 32, as seen in FIG. 2. This establishing distance means 36 can include an indentation or a circumferential groove. In the preferred embodiment, groove 36 is in a plane substantially perpendicular to an elongate axis of shaft 28.

Bias spring 38 is located between retainer cap 32 and the outer side of one handle part 26, as seen in FIG. 3. In the preferred embodiment, one handle part 26 has a well 40 disposed therein. Well 40 will contain spring 38 and it could be made deep enough to contain substantially, if not all of, cap 32 and handle 34. In this way, cap 32 and handle 34 would not be obtrusive to the outside surface of one of said handle parts 26.

Retainer or C-clamp 42, or a like device which can cooperate with distance establishing means 36, is mounted to shaft 28. In the preferred embodiment, C-clamp 42 clamps onto shaft 28 in groove 36, which is at a preselected distance from spring retainer cap 32. This preselected distance is a distance which will maintain spring 38 in adequate preselected compression. Retainer 42 will block shaft 28 from sliding out of mounting hole 30, since spring 38 is biasing cap 32 away from one said mating handle part 26. This compression force will maintain shaft assembly in relative stable alignment with mounting holes 22 when pair of mating handle parts 18 are separated. This facilitates the locking of handle fastener assembly 12 in the blind. Further, since groove 36 is in a plane relatively perpendicular to the elongate axis of shaft 28 C-clamp 42 which mounts to groove 36 will retain shaft assembly 12 in a relatively perpendicular orientation to one said mating handle part 26. This structure further assists the user in locking fastener assembly 12 in the blind.

Cross member 44 is mounted at an end of shaft 28 opposite spring retaining cap 32. Cross member 44 extends laterally away from shaft 28 as seen in FIG. 2. Further cross member 44, is of a greater dimension than the dimension or diameter of mounting hole 30. Thus with the dimension or diameter of mounting hole 30 being smaller than the dimension of cross member 44, this will prevent fastener assembly 12 from sliding through and all the way out of mounting hole 30. In a preferred embodiment, cross member 44 is in a plane relatively perpendicular to an elongate axis of shaft 28.

Fastener assembly 12 has a cross member slot 46 which extends transversely of mounting hole 48 of pair of mounting holes 22 as seen in FIG. 2, which is located in other handle part 50. Slot 46 will receive cross member 44 when the two are aligned. Alignment can be easily obtained by turning handle 34. Once they are aligned, cross member 44 will pass through slot 46.

Once cross member 44 has passed into slog 46, see FIG. 5, handle 34 can be slightly pushed inward, compressing spring 38. This extends cross member 44 to a point just beyond outer surface 52 of other handle part 50 at which point handle 34 can be turned. Cross member 44 will then move over outer surface 52 of other handle part 50. Surface 52 blocks cross member 44 when cross member 44 is in an angular position of nonalignment with cross member slot 46, as seen in FIG. 4, and prevents shaft 28 from sliding back out of mounting hole 48. In a preferred embodiment, cross member 44 will ride over outer surface 52 until it reaches a detent 54 which extends transversely of mounting hole 48 and is in a position of nonalignment with cross member slot 46, as seen in FIG. 4, and member 44 will then be received by detent 54.

As can be seen in FIG. 3, shaft 28 extends between retainer 42 and other handle part 50. This structure permits fastener assembly 12 to releasably fasten mating handle parts 18 at a location where a compartment 16 is formed.

A method of making a tool holder assembly having a pair of mating handle parts 18 which close together and hold a blade tool 14, or the like, includes the step of providing a pair of aligned mounting holes 22 in mating handle parts 18, respectively. The step of passing fastener shaft 28 through one of the mounting holes 30 with a bias spring 38 interposed between an outer side of one of mating handle part 26 and a spring retainer cap 32 carried at one end of shaft 28 is required. A further step is included of connecting retainer 42 to shaft 28 on an inner side 56, FIG. 3, of one handle part 26 after shaft 28 is passed through one mounting hole 30. This blocks removal of shaft 28 from mounting hole 30 and places spring 38 in compression tension. Another step of this method includes attaching cross member 44 to shaft 28 at an end opposite spring retainer cap 32, in which cross member 44 extends laterally from shaft 28. This step of attaching cross member 44 is only done after shaft 28 has passed through mounting hole 30. Finally, the method requires providing cross member slot 46 extending transversely of mounting hole 48 in other mating handle part 50 for receipt of cross member 44 when aligned with slot 46.

In other embodiments, attaching cross member 44 after connecting retainer 42 can be done. Further, mounting holes 22 which are aligned are provided in spaced relationship across formed compartment 16.

Also, this method can include the step of rotating shaft 28 until cross member 44 rides into detent 54 a position transverse to cross member slot 46.

Finally, the method may include the step of inserting bias spring 38 into well 40 to hold it in aligned relationship with spring retainer cap 32 and shaft 28.

While a detailed description of the preferred embodiment of the invention has been given, it should be appreciated that many variations can be made there to without departing from the scope of the invention as set forth in the appended claims.

We claim:

1. In a tool holder assembly having a pair of mating handle parts which close together to hold a tool therebetween and which have spaced apart segments to form a compartment therebetween, the impovement being a releasable handle fastener assembly, comprising:

a pair of aligned mounting holes respectively located in said pair of mating handle parts at said compartment forming segments, respectively;

an elongate shaft assembly mounted to one of said mating handle parts including a shaft slideably extending through the mounting hole in one of said handle parts and having a spring retainer cap on one end of the shaft on an outer side of the one mating handle part, and a means for establishing a preselected distance along said shaft from said spring retainer cap, a bias spring interposed between the cap and the outer side of the one handle part for resiliently biasing the shaft for sliding movement of the cap in a direction away from the outer side of the one handle part, a retainer cooperating with said preselected distance establishing means for mounting thereof to the shaft at a preselected distance from the spring retainer cap to block sliding movement of the shaft in a direction away from the outer side of the one handle part in response to the resilient biasing of the shaft caused by said bias spring and to establish a preselected compression force on said bias spring associated with said preselected distance, and a cross member at an end of the shaft opposite the spring retaining cap and extending laterally away from the shaft; and a cross member slot extending transversely of the mounting hole in the other handle part for receipt of the cross member therethrough when aligned therewith, said cross member overlying an outer surface of the other handle part to block removal of the shaft, which shaft extends between said retainer and the other handle part, when moved to an angular position of nonalignment with the cross member slot.

2. The tool holder assembly of claim 1 in which said hole of one of said mating handle parts to which said shaft is slideably mounted has a dimension smaller than the dimension of said cross member to prevent said shaft assembly from being removed from the one of said mating handle part.

3. The tool holder assembly of claim 2 in which said shaft is round.

4. The tool holder assembly of claim 3 in which said hole is round and has a diameter smaller than the dimension of said cross member.

5. The tool holder assembly of claim 1 includes a handle mounted to said spring retainer cap.

6. The tool holder assembly of claim 5 in which said handle is integral with said spring retainer cap.

7. The tool holder assembly of claim 1 in which said outer side of the one handle part has a spring retainer well for receipt of said spring retainer cap.

8. The tool holder assembly of claim 1 in which said preselected distance establishing means includes an indentation in said shaft.

9. The tool holder assembly of claim 8 in which said indentation is a groove.

10. The tool holder assembly of claim 9 in which said groove is circumferential about said shaft.

11. The tool holder assembly of claim 10 in which the shaft has an elongate axis and in which the groove is in a plane substantially perpendicular to said axis.

12. The tool holder assembly of claim 1 in which said retainer is a C-clamp.

13. The tool holder assembly of claim 1 in which the shaft has an elongate axis and in which said cross member is in a plane substantially perpendicular to said axis.

14. The tool holder assembly of claim 1 in which said outer surface of the other handle part has a detent extends transversely of the mounting hole and in a position of nonalignment with said cross member slot disposed therein for receipt of said cross member.

15. A method of making a tool holder assembly having a pair of mating handle parts which close together to hold a tool therebetween, comprising the steps of:

providing a pair of aligned mounting holes in the mating handle parts, respectively;

passing a fastener shaft through one of the mounting holes with a bias spring interposed between an outer side of the one mating handle part and a spring retainer cap carried at one end of the shaft;

connecting a retainer to the shaft on an inner side of the one handle part after the shaft is passed through the one mounting hole to block removal of the shaft from the one mounting hole and to place the retainer spring in compressive tension;

attaching a cross member to the shaft at an end opposite the spring retainer cap which extends laterally from the shaft after the shaft is passed through the one mounting hole; and providing a cross member slot extending transversely of the mounting hole in the other one of the pair of mating handle parts for receipt of the cross member only when aligned therewith.

16. The method of claim 15 in which said step of cross member attaching is performed after said step of retainer connecting.

17. The method of claim 15 in which said pair of aligned holes are provided in spaced relationship to provide a storage compartment.

18. The method of claim 15 including the step of rotating the fastener shaft until the cross member rides into a detent in a position transverse to the cross member slot.

19. The method of claim 15 including the step of inserting the bias spring into a well to hold it in aligned relationship with the spring retainer cap and the shaft.

* * * * *